US009194208B2

(12) United States Patent
Schultz et al.

(10) Patent No.: US 9,194,208 B2
(45) Date of Patent: Nov. 24, 2015

(54) DOWNHOLE VIBRATORY APPARATUS

(71) Applicant: Thru Tubing Solutions, Inc., Oklahoma City, OK (US)

(72) Inventors: Roger Schultz, Ninnekah, OK (US); Brock Watson, Oklahoma City, OK (US)

(73) Assignee: thru Tubing Solutions, Inc., Oklahoma City, OK (US)

( * ) Notice: Subject to any disclaimer, the term of this patent is extended or adjusted under 35 U.S.C. 154(b) by 373 days.

(21) Appl. No.: 13/739,229

(22) Filed: Jan. 11, 2013

(65) Prior Publication Data

US 2014/0196905 A1 Jul. 17, 2014

(51) Int. Cl.

| | |
|---|---|
| ***E21B 7/24*** | (2006.01) |
| ***E21B 34/06*** | (2006.01) |
| ***E21B 28/00*** | (2006.01) |
| ***E21B 4/02*** | (2006.01) |

(52) U.S. Cl.

CPC . *E21B 34/06* (2013.01); *E21B 4/02* (2013.01); *E21B 28/00* (2013.01)

(58) Field of Classification Search

CPC ..... E21B 28/00; E21B 7/24; E21B 10/36; E21B 6/00; E21B 31/005; E21B 4/02

USPC ..... 175/56, 296

See application file for complete search history.

(56) References Cited

U.S. PATENT DOCUMENTS

| | | | | |
|---|---|---|---|---|
| 2,743,083 | A * | 4/1956 | Zublin | 175/56 |
| 3,096,833 | A * | 7/1963 | Bodine | 175/56 |
| 3,746,310 | A * | 7/1973 | Fransson et al. | 366/120 |
| 5,096,004 | A | 3/1992 | Ide | |
| 5,248,896 | A | 9/1993 | Forrest | |
| 6,279,670 | B1 | 8/2001 | Eddison et al. | |
| 6,431,294 | B1 | 8/2002 | Eddison et al. | |
| 6,439,318 | B1 | 8/2002 | Eddison et al. | |
| 6,508,317 | B2 | 1/2003 | Eddison et al. | |
| 6,588,518 | B2 | 7/2003 | Eddison | |
| 7,077,205 | B2 | 7/2006 | Eddison | |
| 8,069,926 | B2 | 12/2011 | Eddison et al. | |
| 8,167,051 | B2 | 5/2012 | Eddison et al. | |
| 8,469,104 | B2 * | 6/2013 | Downton | 166/373 |
| 8,944,160 | B2 * | 2/2015 | Surjaatmadja et al. | 166/177.6 |
| 2003/0143094 | A1 | 7/2003 | Guo | |
| 2010/0212900 | A1 | 8/2010 | Eddison et al. | |
| 2010/0212912 | A1 | 8/2010 | Eddison et al. | |
| 2011/0031020 | A1 | 2/2011 | Cote | |
| 2011/0073374 | A1 * | 3/2011 | Bunney et al. | 175/107 |
| 2012/0186878 | A1 * | 7/2012 | Eddison | 175/57 |
| 2012/0193145 | A1 | 8/2012 | Anderson | |
| 2015/0144329 | A1 * | 5/2015 | Schultz et al. | 166/241.1 |

OTHER PUBLICATIONS

International Search Report and Written Opinion; International Application No. PCT/US2014/011248; mailed Jun. 17, 2014; 9 pages.

* cited by examiner

*Primary Examiner* — Kenneth L Thompson
(74) *Attorney, Agent, or Firm* — Hall Estill Law Firm

(57) ABSTRACT

The present disclosure is for a vibratory downhole rotary apparatus. The apparatus includes a cylindrical hollow body, a stator disposed within the cylindrical hollow body and a rotor disposed within the stator. The apparatus also includes a flow resistance system to vary the resistance of fluid flow through the apparatus to increase and decrease backpressure across the apparatus.

8 Claims, 10 Drawing Sheets

DOWNHOLE VIBRATORY APPARATUS

STATEMENT REGARDING FEDERALLY SPONSORED RESEARCH OR DEVELOPMENT

Not applicable.

CROSS REFERENCE TO RELATED APPLICATIONS

Not applicable.

BACKGROUND OF THE INVENTION

1. Field of the Invention

The disclosure relates to a vibratory downhole rotary apparatus and a method for use of the apparatus. Generally, but in no way limiting, the downhole rotary apparatus can include a metallic stator.

2. Brief Description of Related Art

Conventional oil and gas drilling involves the rotation of a drill string at the surface which rotates a drill bit mounted to the bottom of the drill string. In other drilling operations, a motor may be used to rotate the drill bit. In these situations it can be more difficult to advance the drill bit in a hydrocarbon formation. These motors are also used with coiled tubing and jointed pipe in completions and other operations. These motors typically include rotors disposed within elastomeric stators. Elastomeric stators can have deficiencies when it comes to breaking down and handling the operating conditions imparted upon them during downhole operations. Downhole motors coupled to conventional mechanical valves are used in some vibratory tools. The mechanical valves used in these tools, which vary the flow area through a flow aperture require substantial torque for operation. Currently, motor with elastomeric stators are the only suitable downhole motor type which can produce enough torque to operate these mechanical valves. This high torque requirement dictates that the rotors and stators must have substantial length in order to provide the required internal torque to operate the tool.

To this end, a need exists for a vibratory downhole rotary apparatus that can operate with a low internal torque and is constructed of materials more suited to the operating conditions and wear and tear from use.

SUMMARY OF THE INVENTION

The present disclosure is directed to a vibratory downhole rotary apparatus. The apparatus includes a cylindrical hollow body having a first end and a second end. The apparatus further includes a stator disposed within the cylindrical hollow body and a rotor disposed within the stator. The apparatus also includes a flow resistance system to vary the resistance of fluid flow through the apparatus to increase and decrease backpressure across the apparatus.

The present disclosure is directed to another embodiment of a vibratory downhole rotary apparatus. The apparatus includes a cylindrical hollow body having a first end and a second end. The apparatus further includes a stator disposed within the cylindrical hollow body and a rotor disposed within the stator. A portion of the rotor has an internal passageway that is in fluid communication with the second end of the cylindrical hollow body. The rotor also includes a fluid port to permit fluid to flow from between the stator and rotor to the internal passageway of the rotor.

The present disclosure is directed to a further embodiment of a vibratory downhole apparatus having a fluid passage flow area. The apparatus includes a cylindrical hollow body having a first end and a second end. The apparatus further includes a stator disposed within the cylindrical hollow body and a rotor disposed within the stator. The apparatus also includes a rotatable fluid passage body attached to the rotor and disposed within the cylindrical hollow body, the rotatable fluid passage body having a fluid passage opening therein. Additionally, the apparatus includes a fluid flow restrictor positioned adjacent to the rotatable fluid passage body and disposed within the cylindrical hollow body, the fluid flow restrictor causing alternating increasing and decreasing flow resistance to fluid flowing through the apparatus. The fluid passage flow area of the apparatus is constant.

DETAILED DESCRIPTION OF EXEMPLARY EMBODIMENTS

Figure 1:
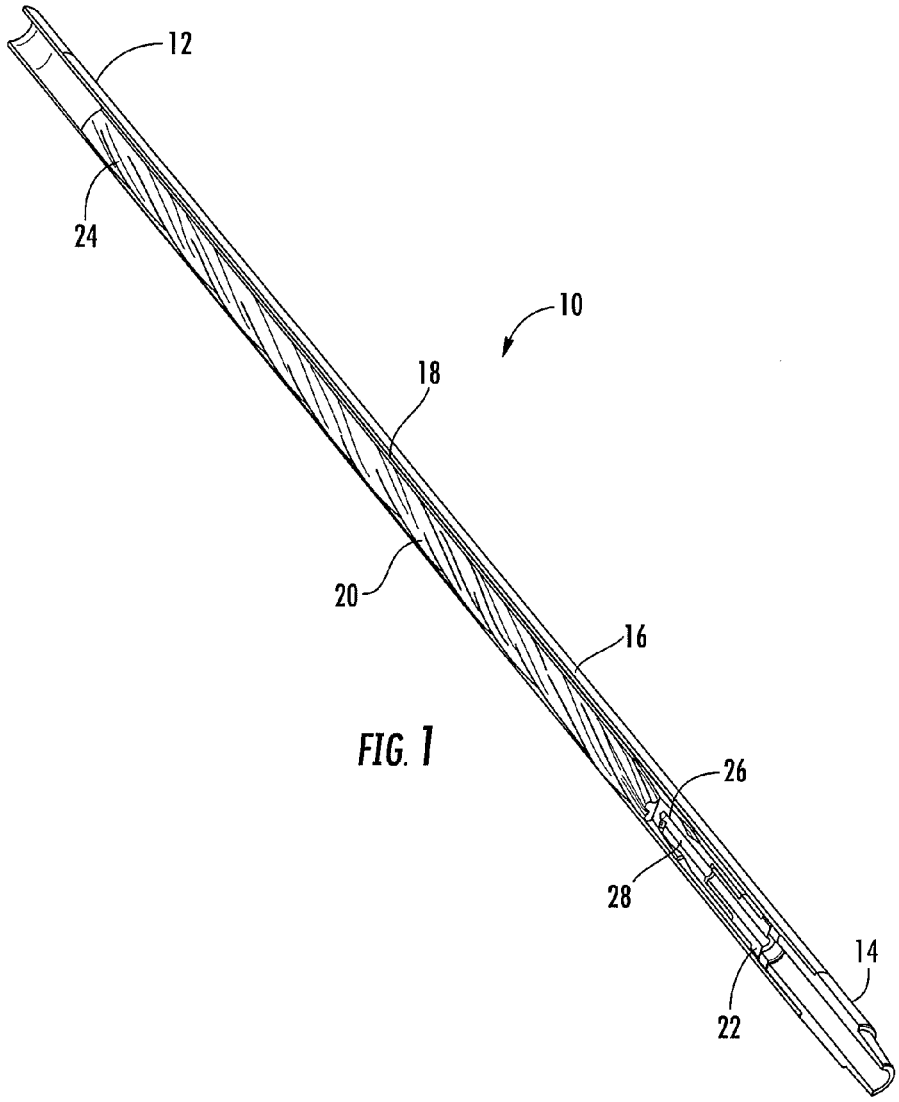
FIG. 1 is a perspective view of a vibratory downhole rotary apparatus constructed in accordance with the present disclosure.

Before explaining at least one embodiment of the presently disclosed and claimed inventive concept(s) in detail, it is to be understood that the presently disclosed and claimed inventive concept(s) is not limited in its application to the details of construction, experiments, exemplary data, and/or the arrangement of the components set forth in the following description or illustrated in the drawings. The presently disclosed and claimed inventive concept(s) is/are capable of other embodiments or of being practiced or carried out in various ways. Also, it is to be understood that the phraseology and terminology employed herein is for the purpose of description and should not be regarded as limiting.

Figure 2A:
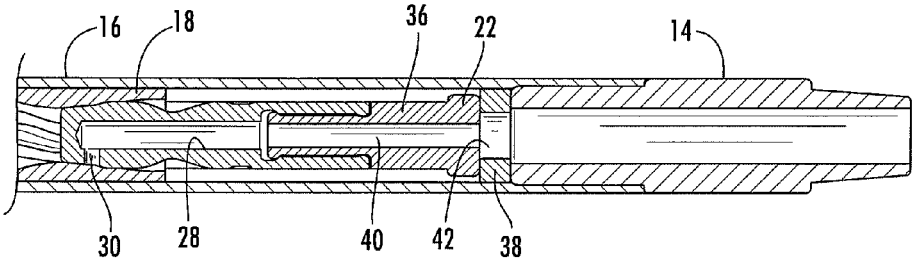
FIG. 2A is a cross-sectional view of a portion of the vibratory downhole rotary apparatus.
Figure 2B:
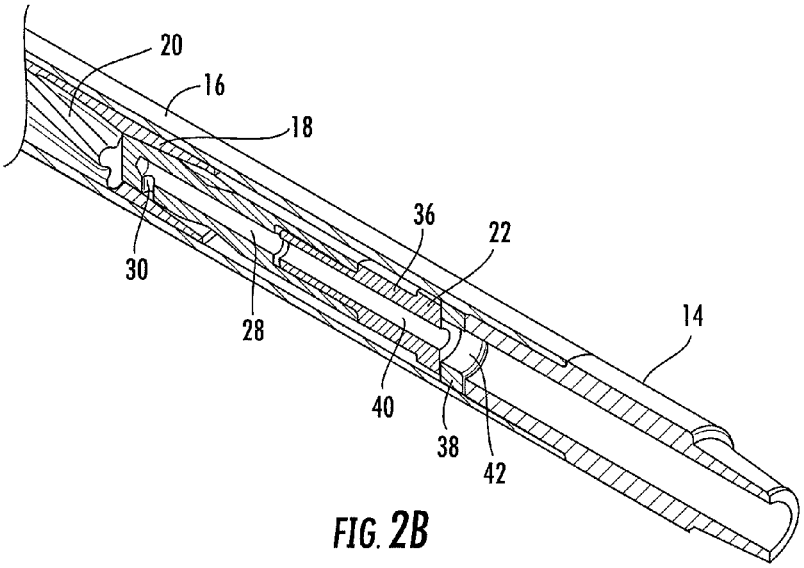
FIG. 2B is a perspective view of a portion of the vibratory downhole rotary apparatus.

The present disclosure relates to vibratory downhole rotary tools wherein the vibratory aspects of the tools described herein are due to variable flow resistance of the fluid through the tools. The variable flow resistance can be due to flow resistance systems included in the tools. Referring now to the drawings, FIGS. 1, 2A and 2B illustrate a vibratory downhole rotary apparatus 10 that can be incorporated into a tubular workstring (drill string, jointed tubing, coiled tubing) drill string. The apparatus 10 can be a progressive cavity positive displacement motor, such as a Moineau principle motor. The apparatus 10 has a first end 12 and a second end 14. The apparatus 10 includes a substantially cylindrical hollow body 16, at least a partially non-elastomeric stator 18 disposed within the cylindrical hollow body 16, a rotor 20 rotatably disposed within the non-elastomeric stator 18, and a flow resistance system 21. The flow resistance system 21 includes a bearing assembly 22 disposed at the second end 14 of the apparatus 10. The flow resistance system 21 is included to vary the resistance of the flow of fluid through the apparatus 10 to increase and decrease the backpressure across the apparatus 10 which causes the apparatus 10 to vibrate. In one embodiment, the entire stator 18 can be constructed of non-elastomeric materials. Lower internal torques are required for the apparatus 10, thus non-elastomeric materials can be used for the stator 18.

The rotor 20 includes a first end portion 24 and a second end portion 26. The second end portion 26 of the rotor 20 is positioned adjacent to the bearing assembly 22 of the apparatus 10 and includes an internal passageway 28 extending within a length of the rotor 20. In one embodiment, the second end portion 26 of the rotor 20 has a fluid port 30 in fluid communication with fluid traveling through the apparatus 10 and the internal passageway 28 in the second end portion 26 of the rotor 20. The fluid port 30 is also part of the flow resistance system 21 of the apparatus 10. The fluid port 30 permits fluid to pass from between the rotor 20 and stator 18 to the internal passageway 28 in the second end portion 26 of the rotor 20 and out the second end 14 of the apparatus 10. It should be understood and appreciated that the fluid port 30 can be in any location on the rotor 20 to facilitate fluid passing from between the rotor 20 and stator 18 to the internal passageway 28 in the second end portion 26 of the rotor 20 and out the second end 14 of the apparatus 10.

In accordance with Moineau principles, the rotor 20 can have at least one lobe 32 and the stator 18 can have $_{NL}$+1 ($_{NL}$ is the number of lobes on the rotor) cavities 34 for receiving the rotor lobes 32. In one embodiment shown in FIGS. 3A and 3B, the fluid port 30 can be disposed through one of the five lobes 32 of the rotor 20 substantially perpendicular to the length of the internal passageway 28 of the rotor 20. The fluid port 30 is designed such that as the rotor 20 turns inside the stator 18, fluid flow through the fluid port 30 is progressively blocked as the rotor 20 turns inside the stator 18 and is substantially blocked for one instant when the lobe 32 with the fluid port 30 disposed therein is positioned completely within one of the cavities 34 of the stator, and is then progressively unblocked as the rotor 20 continues to turn. When the fluid is blocked from flowing through the fluid port 30, pressure is built up in the apparatus 10. This pressure is relieved from the apparatus 10 once the fluid port 30 is rotated into an open position within the stator 18. As the rotor 20 turns in the stator 18, the fluid port 30 is repeatedly moved through the open and closed positions which oscillates the pressure above the flow resistance system 21 and apparatus 10 and causes vibration of the apparatus 10.

Figure 3A:
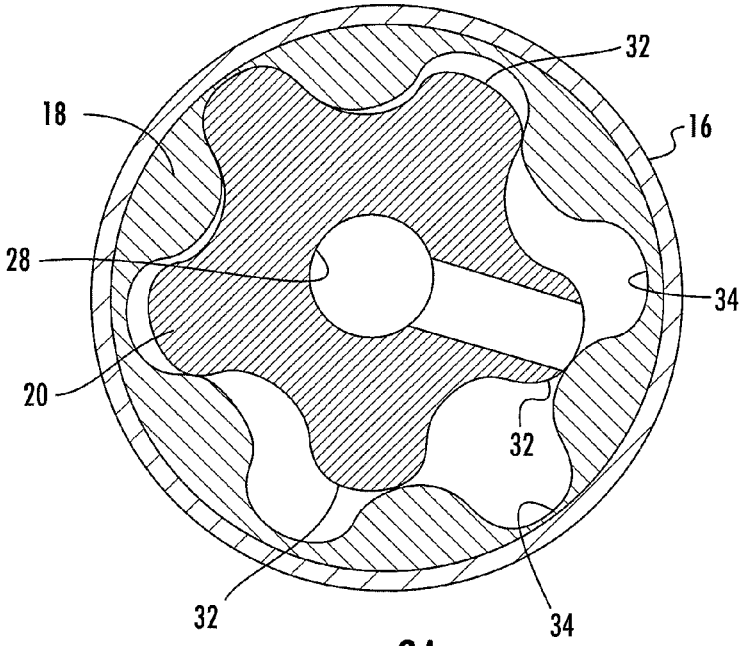
FIG. 3A is a cross-sectional view of a rotor and stator in accordance with the present disclosure.
Figure 3B:
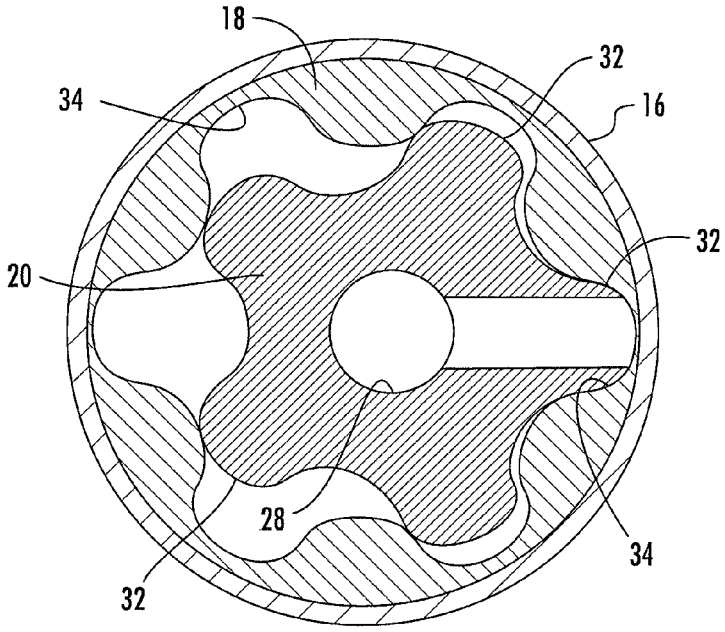
FIG. 3B is another cross-sectional view of the rotor and stator in accordance with the present disclosure.

It should be understood and appreciated that while five rotor lobes 32 and six stator cavities 34 are shown in FIGS. 3A and 3B, the apparatus 10 is not limited to any set number of rotor lobes 32 and stator cavities 34.

The stator 18 can be constructed of a non-elastomeric material or substantially metallic materials. The stator 18 must withstand extreme operating conditions and the opening and closing of the fluid port 30 of the rotor 20. Non-elastomeric materials and/or substantially metallic materials will not break down as easily and thus, can withstand the operating conditions the apparatus 10 is subjected to.

The bearing assembly 22 includes an upper thrust bearing 36 attached to the second end portion 26 of the rotor 20 and a lower thrust bearing 38 that is stationary inside the hollow body 16 of the apparatus 10. The upper thrust bearing 36 rotates and slides against the lower thrust bearing 38 as the rotor 20 rotates and orbits within the stator 18.

The upper thrust bearing 36 and the lower thrust bearing 38 include fluid passageways 40 and 42, respectively, disposed therein. The fluid passageways 40 and 42 are in fluid communication with the internal passageway 28 of the rotor 20 and permit fluid to flow from the second end 14 of the apparatus 10.

Figure 4:
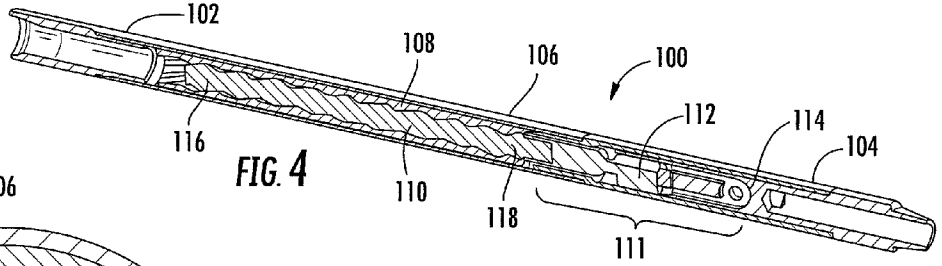
FIG. 4 is a perspective view of another embodiment of a vibratory downhole rotary apparatus constructed in accordance with the present disclosure.
Figure 6:
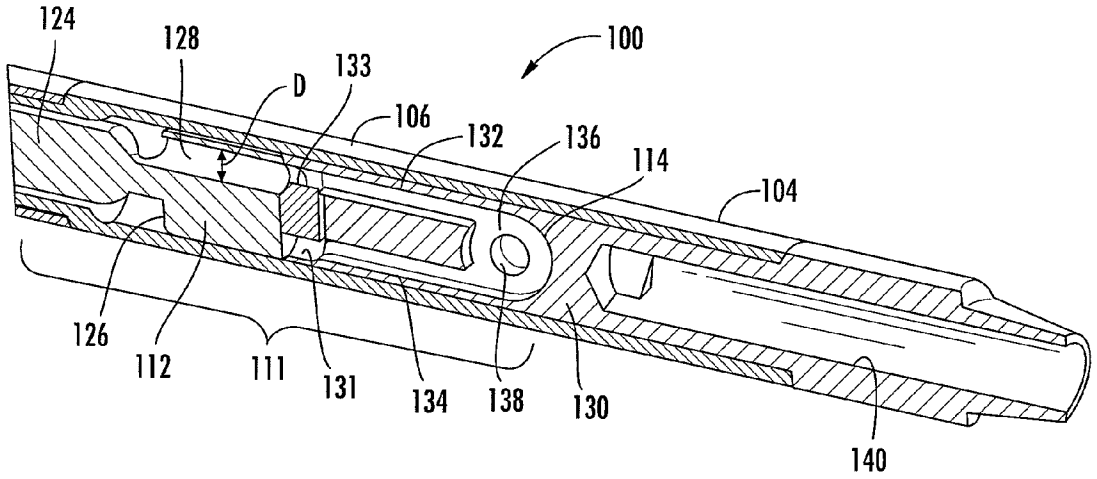
FIG. 6 is a perspective view of a portion of the vibratory downhole rotary apparatus constructed in accordance with the present disclosure.
Figure 7:
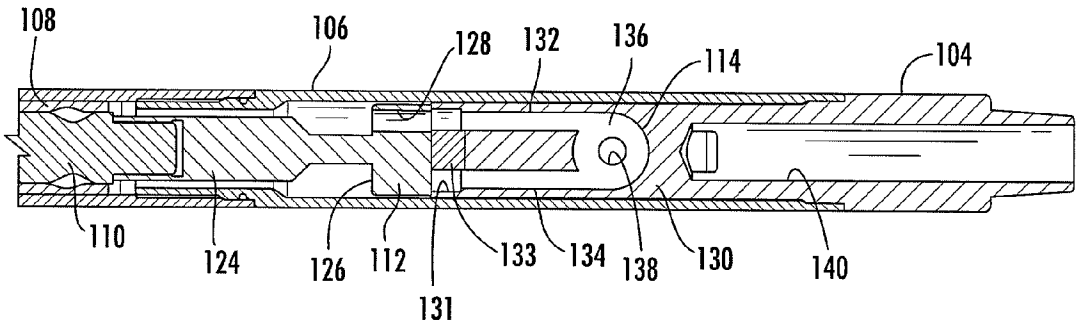
FIG. 7 is a cross-sectional view of a portion of the vibratory downhole rotary apparatus constructed in accordance with the present disclosure.

Referring now to FIGS. 4, 6 and 7, shown therein is another embodiment of a vibratory downhole rotary apparatus 100 that can be incorporated into a workstring. Similar to the other embodiments described herein, the apparatus 100 can be a progressive cavity positive displacement motor, such as a Moineau principle motor. The apparatus 100 has a first end 102, a second end 104, a substantially cylindrical hollow body 106, a stator 108 disposed within the cylindrical hollow body 106, a rotor 110 rotatably disposed within the stator 108, and a flow resistance system 111 to vary the resistance of fluid flowing through the apparatus 100. The flow resistance system 111 includes a rotatable fluid passage body 112 attached to the rotor 110, and a fluid flow restrictor 114 disposed adjacent to the rotatable fluid passage body 112 in the second end 104 of the apparatus 100. The apparatus 100 disclosed herein can operate at a very low internal torque. The apparatus 100 is operational at a lower internal torque which allows for the length of the stator 108 and the rotor 110 to be shorter, which creates a more compact tool.

A typical Moineau motor will have several "stages". A stage is a sealed cavity which is formed between the stator 108 and the rotor 110. This sealed cavity travels down the length of the rotor 110/stator 108 as the rotor 110 rotates within the stator 108. As a stage travels past the end of the rotor 110/stator 108 the fluid in a particular stage is exhausted from between the rotor 110 and the stator 108 at the discharge end of the rotor 110/stator 108 interface. The length of a stage is dictated by the pitch and other geometry of the rotor 110 and stator 108. Motors are typically long enough to accommodate several stage lengths. Each stage length adds additional torque output to the motor design. Applications requiring high torque will require more stages than applications requiring less torque. If less torque is required, fewer stage lengths are required. This means that the necessary motor length decreases with the amount of torque a specific application requires. There has to be at least one stage length in order for the rotor 110/stator 108 to form a sealed cavity so it can operate. In most motor and vibratory tool applications there are 3 to 7 stages. This results in a motor length to diameter of the motor ratio of about 30. In the embodiment shown in FIG. 4 the number of stages required is only about 1.2 because the torque requirement is very low. In one embodiment, the ratio of the length of the rotor 110/stator 108 to the diameter of the motor is less than about 20. In another embodiment, the ratio of the length of the rotor 110/stator 108 to the diameter of the motor is less than about 15. In a further embodiment, the ratio of the length of the rotor 110/stator 108 to the diameter of the motor is less than about 10. This means that in the low torque vibratory tool embodiment the length of the rotor 110/stator 108 can be only about ⅓ the typical length required for conventional vibratory tools.

Figure 5B:
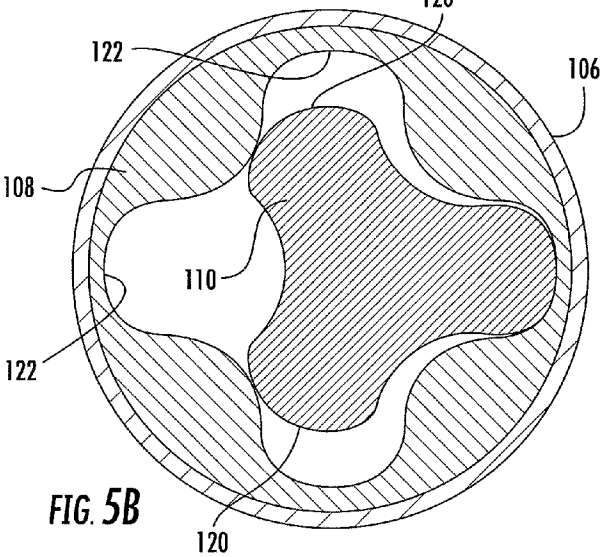
FIG. 5B is another cross-sectional view of the rotor and stator constructed in accordance with another embodiment of the present disclosure.
Figure 5A:
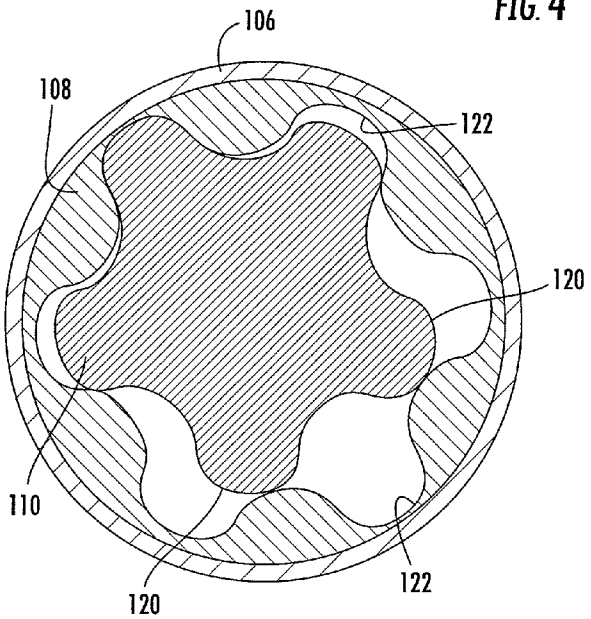
FIG. 5A is a cross-sectional view of a rotor and stator constructed in accordance with another embodiment.

The rotor 110 includes a first end 116 and a second end 118. The rotor 110 is rotatably positioned within the stator 108 wherein fluid can pass from the first end 102 of the apparatus 100, between the rotor 110 and the stator 108 and ultimately out the second end 104 of the apparatus 100. It should be understood and appreciated the fluid can enter the apparatus 100 and be positioned between the rotor 110 and the stator 108 at any point along the cylindrical hollow body 106. In accordance with Moineau principles, the rotor 110 can have at least one lobe 120 and the stator 108 can have $N_L+1$ ($N_L$ is the number of lobes on the rotor) cavities 122 for receiving the rotor lobes 120. In one embodiment, FIG. 5A shows a cross-section of the rotor 110 having five lobes 120 and the stator 108 having six cavities 122. FIG. 5B shows another embodiment of the apparatus 100 wherein the rotor 110 has three lobes 120 and the stator 108 having four cavities 122. It should be understood and appreciated that the embodiments shown in FIGS. 5A and 5B are exemplary only and the apparatus 100 is not limited to any set number of rotor lobes 120 and stator cavities 122.

The rotatable fluid passage body 112 has a rotor attachment end 124 attached to the second end 118 of the rotor 110 and fluid passage end 126 positioned adjacent to the fluid flow restrictor 114. The fluid passage end 126 has a fluid passage opening 128 disposed therein to permit the fluid that passes from between the rotor 110 and the stator 108, around a portion of the rotatable fluid passage body 112 and through the fluid passage opening 128 to the fluid flow restrictor 114. The fluid passage opening 128 can be positioned in the fluid passage end 126 at a predetermined position such that fluid is directed from the rotatable fluid passage body 112 and directly into the fluid flow restrictor 114 at a desired position. The fluid passage end 126 of the rotatable fluid passage body 112 can also be designed such that no fluid can pass by the rotatable fluid passage body 112 except through the fluid passage opening 128.

In one embodiment, the fluid passage opening 128 has a substantially cylindrical shape with a diameter (D) and the opening 128 extends substantially parallel to the cylindrical hollow body 106 along the length of the fluid passage end 126 of the rotatable fluid passage body 112. In another embodiment, the diameter D of the opening 128 decreases along the length of the opening 128 in the direction towards the fluid flow restrictor 114. The decreasing diameter in the opening 128 creates a nozzle that increases the velocity of the fluid as it exits the opening 128 of the rotatable fluid passage body 112 and enters the fluid flow restrictor 114. It should be understood and appreciated that while a substantially cylindrical shape (a circular cross-section) is described herein for the opening 128, the opening 128 can have any cross-sectional shape such that fluid can pass through the fluid passage end 126 of the rotatable fluid passage body 112.

The fluid flow restrictor 114 can be disposed within a lower thrust bearing 130. The lower thrust bearing 130 is rigidly disposed within the cylindrical hollow body 106 adjacent to the rotatable fluid passage body 112. The lower thrust bearing 130 can include an annular cavity 131 that is in constant fluid communication with the opening 128 of the rotatable fluid passage body 112. The lower thrust bearing 130 can also include a button 133 that is the primary contact point of the rotatable fluid passage body 112. Hydraulic pressure acting across a hydraulic cross-section of the rotor 110 generates a downward force on the rotor 110. This force on the rotor 110 forces the rotatable fluid passage body 112 into contact with the lower thrust bearing 130. Due to this contact and the rotation of the rotatable fluid passage body 112, the button 133 of the lower thrust bearing 130 experiences both rotational and sliding contact with the rotatable fluid passage body 112. The button 133 can be constructed of sufficient material to handle the downward force and the rotating and sliding friction experienced when the button 133 is in contact with the rotatable fluid passage body 112. The downward hydraulic force is generated by the hydraulic cross-section of the rotor 110 is greatly countered by the upward hydraulic force generated by the pressure occurring within the annular cavity 131 which is upstream of the fluid flow restrictor 114. This reduced force significantly reduces the friction between the thrust bearing surfaces thereby greatly reduction the torque required to operate the apparatus 100.

The fluid flow restrictor 114 includes a first inlet port 132, a second inlet port 134, a vortex chamber 136 in fluid communication with the first inlet port 132 and the second inlet port 134, and a first outlet 138 disposed in the vortex chamber 136. When the rotatable fluid passage body 112 is rotated by the rotor 110, the opening 128 is periodically aligned with the first inlet port 132 of the fluid flow restrictor 114. When the opening 128 is aligned with the first inlet port 132, fluid is permitted to flow directly into the vortex chamber 136 via the first inlet port 132 of the fluid flow restrictor 114. In one embodiment, the first inlet port 132 and the second inlet port 134 direct fluid into the vortex chamber 136 substantially tangential to the vortex chamber 136. The fluid flowing into the vortex chamber 136 will flow clockwise in the vortex chamber 136 and the flow resistance will quickly increase causing backpressure across the apparatus 100 as a clockwise vortex forms in the vortex chamber 136 and increases strength. The backpressure increases strength and the fluid is forced out of the first outlet 138 in the fluid flow restrictor 114. The first inlet port 132 can be positioned in any orientation with respect to the vortex chamber 136 such that a clockwise vortex can be generated therein.

The apparatus 100 has a fluid passage flow area. The fluid passage flow area is the cross-sectional flow area seen by fluid as it flows through the flow resistance system 111 of the apparatus 100. The size of the flow area is not constant from the entrance to the exit of the flow resistance system 111, but the flow area at any point along the flow path is constant and never changes regardless of the relative position of the rotatable fluid passage body 112 to the lower thrust bearing 130. The fluid passage flow area of the apparatus 100 is constant at any given point along the flow path. In other words, the fluid passage flow area of the apparatus 100 is never restricted by any type of mechanical opening or closing of any type of passageway. The fluid passage opening 128 is constantly open to the annular cavity 131 of the lower thrust bearing 130 and the annular cavity 131 is in constant fluid communication with the first inlet port 132 and the second inlet port 134 of the fluid flow restrictor 114.

Fluid exiting the outlet 138 of the fluid flow restrictor 114 proceeds out an opening 140 in the second end 104 of the apparatus 100. In another embodiment, the fluid flow restrictor 114 includes a second outlet (not shown) disposed in the vortex chamber 136 opposite the first outlet 138 in the vortex chamber 136 (FIGS. 4, 6, and 7 only show a cross-section or a perspective view of one half of the apparatus 100). It should be understood and appreciated that this build-up of backpressure and the creation of the vortex occurs in the time it takes the opening 128 to align with the first inlet port 132 and then be rotated away from the first inlet port 132.

Figure 8A:
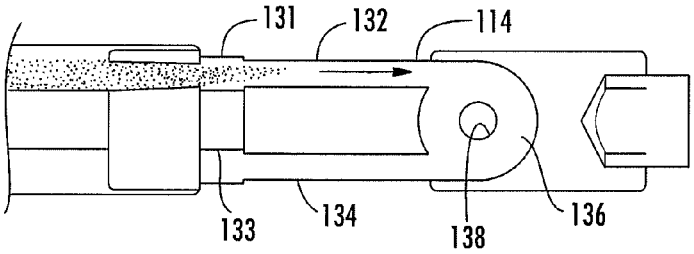
FIGS. 8A-8E is a sequential schematic illustration of fluid flow through a fluid flow restrictor constructed in accordance with the present disclosure.
Figure 8B:
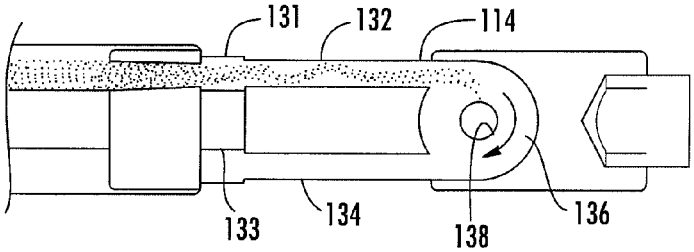
Figure 8C:
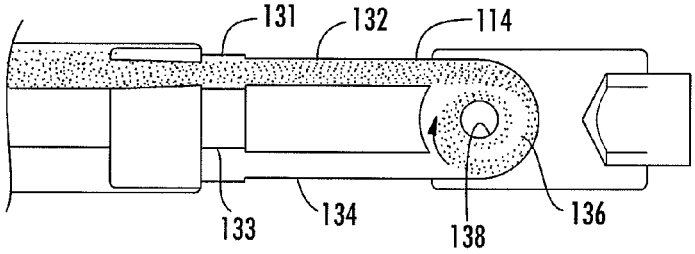
Figure 8D:
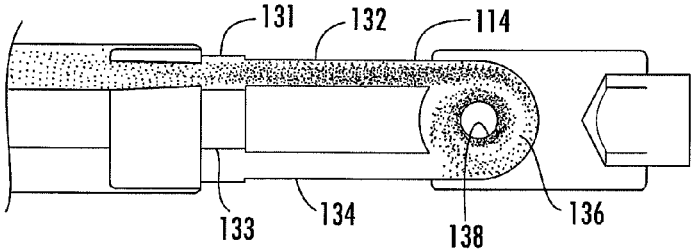
Figure 8E:
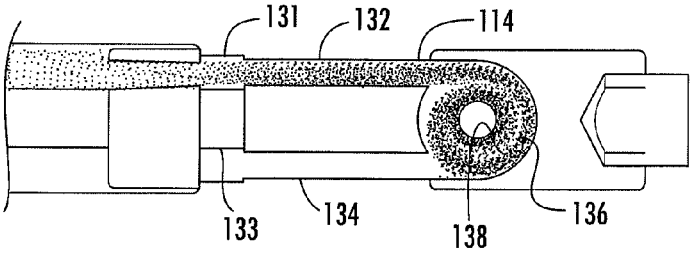
Figure 9A:
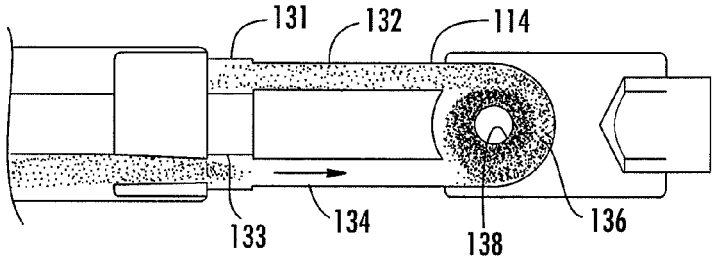
FIGS. 9A-9E is a sequential schematic illustration of fluid flow through a fluid flow restrictor constructed in accordance with the present disclosure.
Figure 9B:
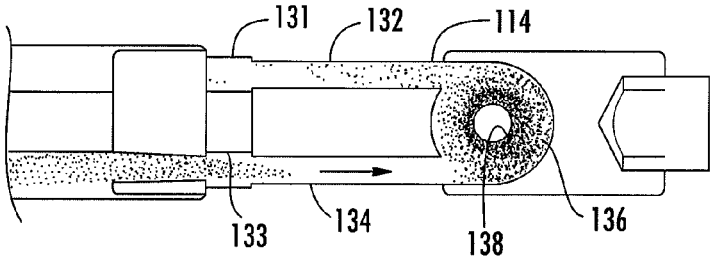
Figure 9C:
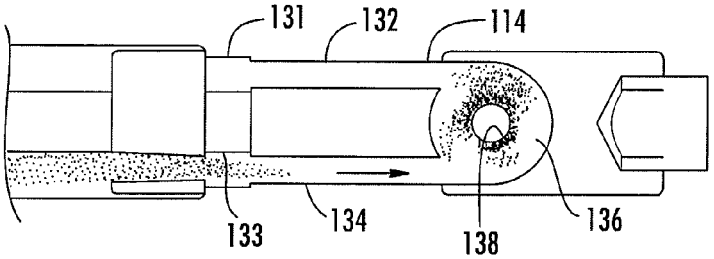
Figure 9D:
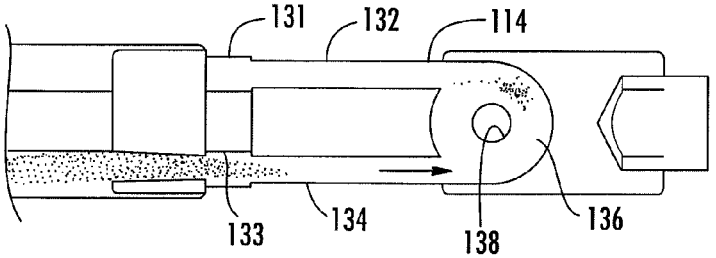
Figure 9E:
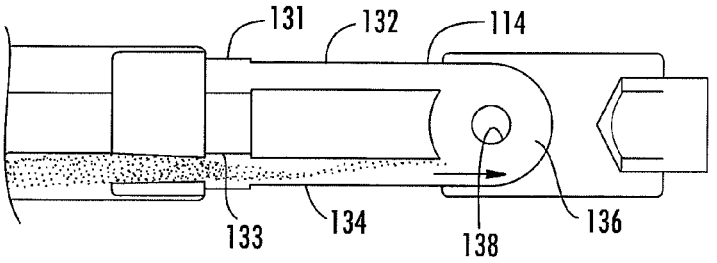

FIGS. 8A-8E show the build-up of the clockwise vortex in the vortex chamber 136 when the opening 128 of the rotatable fluid passage body 112 is in alignment with the first inlet port 132 of the fluid flow restrictor 114. FIGS. 8A and 8B show the fluid flowing into the first inlet port 132 and beginning to form the clockwise vortex in the vortex chamber 136. FIGS. 8C and 8D show the build-up of the clockwise vortex in the vortex chamber 136 of the fluid flow restrictor 114. FIG. 8E shows the fully mature clockwise vortex developed in the vortex chamber 136. When the clockwise vortex in the vortex chamber 136 is fully mature, the pressure drop across the apparatus 100 is extremely high.

After the fluid passage opening 128 is rotated away from being aligned with the first inlet port 132, the fluid passage opening 128 will eventually become aligned with the second inlet port 134. When the opening 128 is aligned with the second inlet port 134, fluid is permitted to enter the vortex chamber 136 directly via the second inlet port 134 of the fluid flow restrictor 114. The fluid flowing into the vortex chamber 136 via the second inlet port 134 will oppose the flow of fluid that had entered the vortex chamber 136 via the first inlet port 132 and quickly decay the clockwise vortex that had been created in the vortex chamber 136. FIGS. 9A-9E show the decay of the clockwise vortex in the vortex chamber 136 as the opening 128 is initially aligned with the second inlet port 134 of the fluid flow restrictor 114, and fluid is permitted to enter the vortex chamber 136 via the second inlet port 134. The pressure across the apparatus 100 drops as the clockwise vortex decays.

After the clockwise vortex is decayed, the fluid entering the vortex chamber 136 via the second inlet port 134 will flow counter-clockwise in the vortex chamber 136 and again the flow resistance will quickly increase causing the backpressure across the apparatus 100 as a counter-clockwise vortex forms in the vortex chamber 136 and increases strength as the fluid is forced out of the outlet 138 in the fluid flow restrictor 114. The second inlet port 132 can be positioned in any orientation with respect to the vortex chamber 136 such that a counter-clockwise vortex can be generated therein. It should be understood and appreciated that this build-up of backpressure and the creation of the vortex occurs in the time it takes the opening 128 to align with the second inlet port 134 and then be rotated away from the first inlet port 132.

Figure 10A:
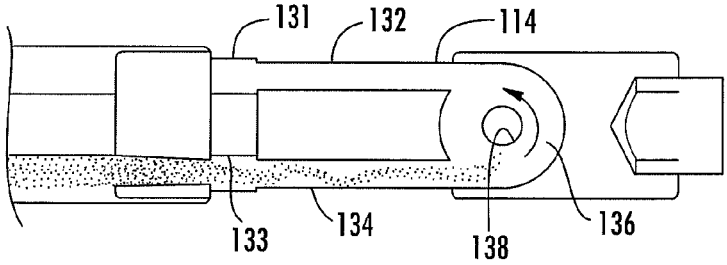
FIGS. 10A-10E is a sequential schematic illustration of fluid flow through a fluid flow restrictor constructed in accordance with the present disclosure.
Figure 10B:
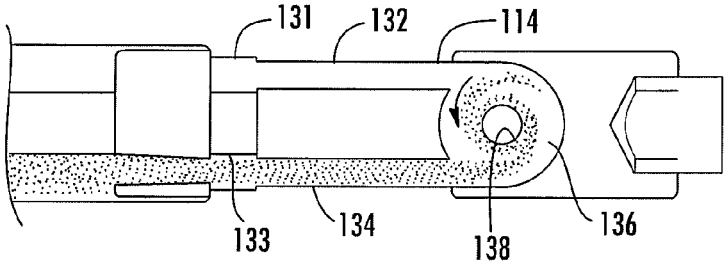
Figure 10C:
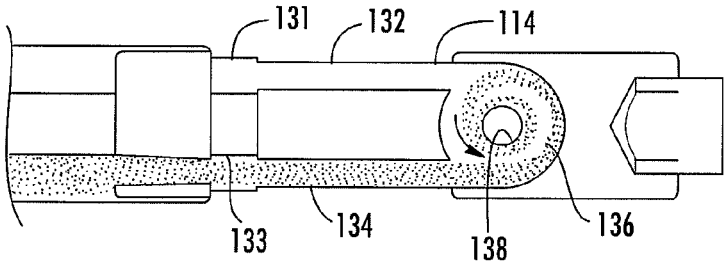
Figure 10D:
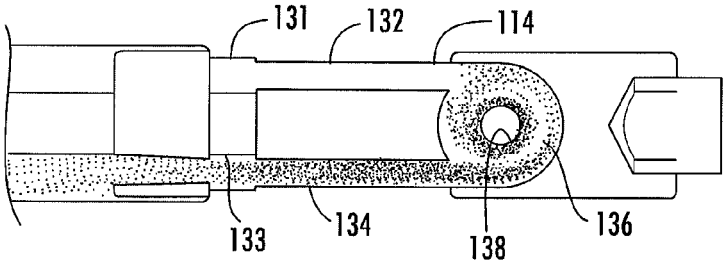
Figure 10E:
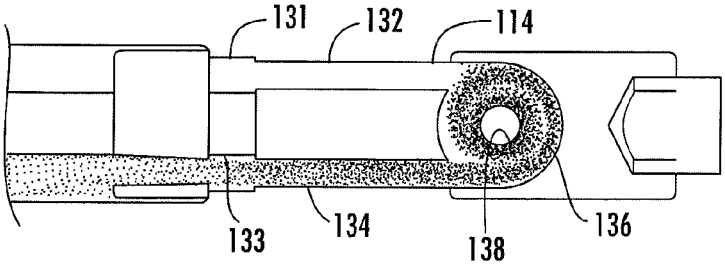

FIGS. 10A-10E show the build-up of the counter-clockwise vortex in the vortex chamber 136 when the opening 128 of the rotatable fluid passage body 112 is in alignment with the second inlet port 134 of the fluid flow restrictor 114. FIGS. 10A and 10B show the fluid flowing into the second inlet port 134 and beginning to form the counter-clockwise vortex in the vortex chamber 136. FIGS. 10C and 10D show the build-up of the counter-clockwise vortex in the vortex chamber 136 of the fluid flow restrictor 114. FIG. 10E shows the fully mature counter-clockwise vortex developed in the vortex chamber 136. Similar to the clockwise vortex being created in the vortex chamber 136, when the counter-clockwise vortex in the vortex chamber 136 is fully mature, the pressure drop across the apparatus 100 is also extremely high.

Figure 11:
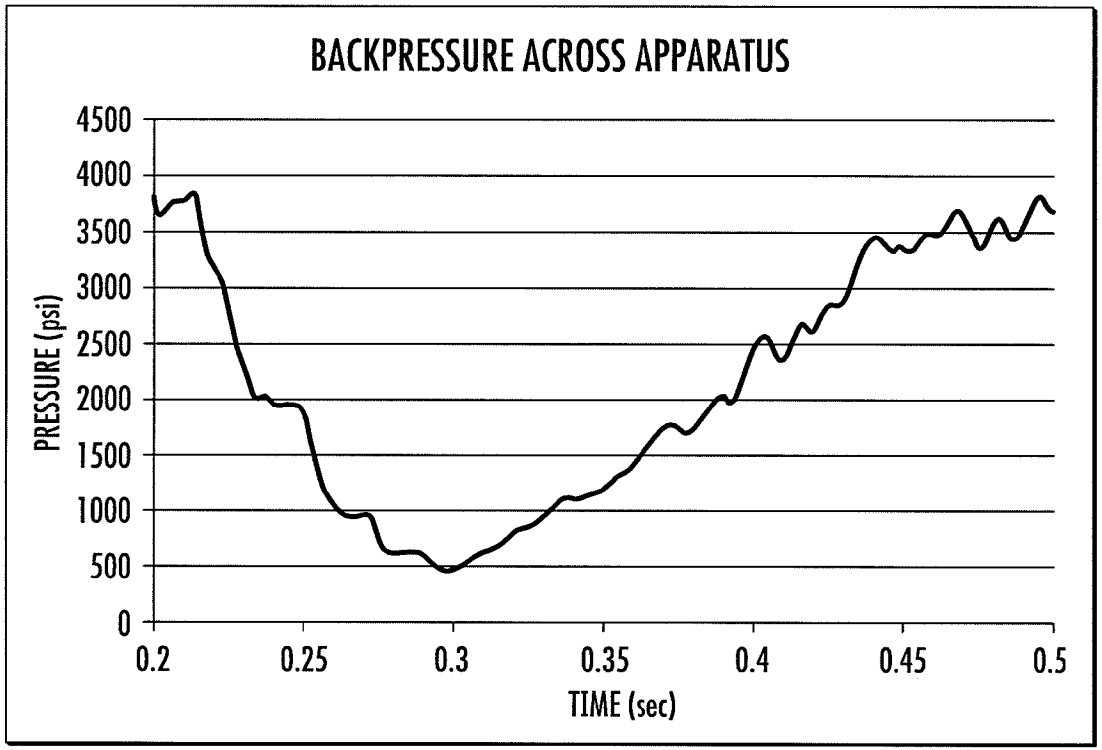
FIG. 11 is a computational fluid dynamic (CFD) generated back-pressure across an apparatus constructed in accordance with the present disclosure.

It should be understood and appreciated that as the rotatable fluid passage body 112 rotates and repositions the fluid passage opening 128 from being aligned with the second inlet port 134 to being back in alignment with the first inlet port 132, the counter-clockwise vortex created is decayed and the clockwise vortex described herein is regenerated. As the rotatable fluid passage body 112 and the opening 128 rotates, the clockwise and counter-clockwise vortices are created and destroyed one after the other. FIG. 11 shows the pressure drop across the apparatus 100 from the time the clockwise vortex is disrupted and the counter-clockwise vortex is generated. FIG. 11 also shows that in one embodiment, it takes about 0.3 seconds for the apparatus 100 to go from the matured clockwise vortex to the matured counter-clockwise vortex. A cyclical increase and decrease in pressure drop across the apparatus 100 is generated as the rotor 110 turns the rotatable fluid passage body 112. The cyclical increase and decrease in pressure drop across the apparatus 100 in short amounts of time causes the apparatus 100 to be vibrated. It should also be noted that the apparatus 100 stays in the high backpressure state when the opening 128 rotates between the first and second inlet ports 132 and 134 (and vice versa).

Figure 12:
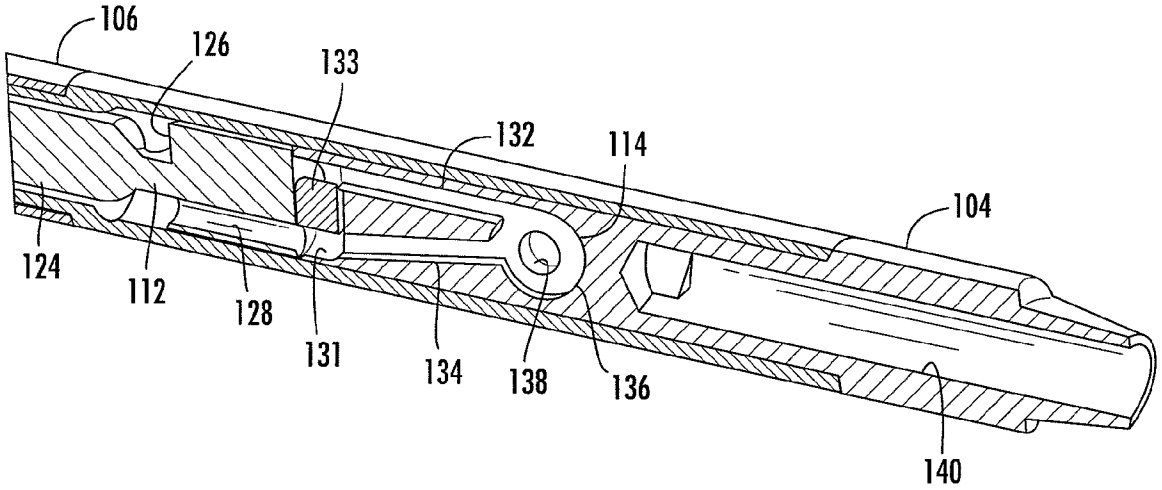
FIG. 12 is a perspective view of a portion of another vibratory downhole rotary apparatus constructed in accordance with the present disclosure.
Figure 13:
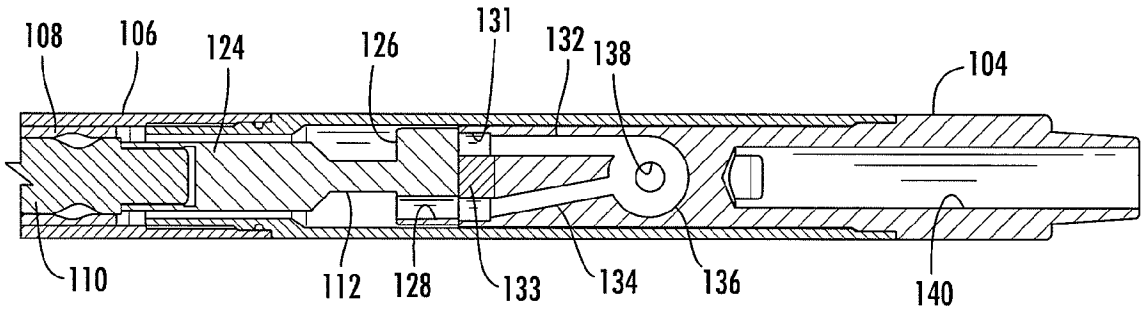
FIG. 13 is a cross-sectional view of a portion of another vibratory downhole rotary apparatus constructed in accordance with the present disclosure.

FIGS. 12 and 13 show another embodiment of the apparatus 100 constructed in accordance with the present disclosure. In this embodiment, the second inlet port 134 is disposed in the fluid flow restrictor 114 such that when the opening 128 is aligned with the second inlet port 134, fluid is directed toward a center portion of the vortex chamber 136 (generally towards the outlet(s) 138), as opposed to substantially tangential as described previously herein. Directing the fluid towards the center portion of the vortex chamber 136 disrupts the vortex formed when the opening 128 was aligned with the first inlet port 132 and permits the fluid to flow through the outlet(s) 138 of the fluid flow restrictor 114 with far less resistance, and without the formation of vertical flow within the vortex chamber 136. The lack of resistance on the fluid prevents a large increase in pressure drop over the apparatus 100. In this embodiment, there would only be one pressure drop increase across the apparatus 100 for every rotation of the rotatable fluid passage body 112 via the rotor 110 instead of two pressure drop increases across the apparatus 100 for every rotation of the rotatable fluid passage body 112 via the rotor 110.

The stator 108 can be constructed of any material such that the stator 108 can withstand the operating conditions to which the stator 108 will be subjected. In one embodiment, the stator 108 can be an elastomeric material, a non-elastomeric material, or a substantially metallic material.

From the above description, it is clear that the inventive concepts disclosed and claimed herein are well adapted to carry out the objects and to attain the advantages mentioned herein, as well as those inherent in the invention. While various embodiments of the inventive concepts have been described for purposes of this disclosure, it will be understood that numerous changes may be made which will readily suggest themselves to those skilled in the art and which are accomplished within the spirit of the inventive concepts disclosed and as defined in the appended claims.

What is claimed is:

1. A vibratory downhole rotary apparatus having a fluid passage flow area, the apparatus comprising:

a cylindrical hollow body having a first end and a second end;

a stator disposed within the cylindrical hollow body;

a rotor rotatably disposed within the stator;

a rotatable fluid passage body attached to the rotor and disposed within the cylindrical hollow body, the rotatable fluid passage body having a fluid passage opening therein;

a fluid flow restrictor positioned adjacent to the rotatable fluid passage body and disposed within the cylindrical hollow body, the fluid flow restrictor causing alternating increasing and decreasing flow resistance to fluid flowing through the apparatus; and wherein the fluid passage flow area of the apparatus is constant.

2. The apparatus of claim 1 wherein the fluid passage opening is cylindrically shaped and has a diameter that decreases in the direction from the first end towards the second end of the cylindrical hollow body.

3. The apparatus of claim 1 wherein the fluid flow restrictor comprises:

a vortex chamber;

a plurality of fluid inlet ports in fluid communication with the vortex chamber; and an outlet disposed in the vortex chamber to permit fluid to exit the vortex chamber and ultimately exit the second end of the cylindrical hollow body.

4. The apparatus of claim 3 wherein the fluid flow restrictor includes:

a first inlet port in fluid communication with the vortex chamber, the first inlet port positioned such that during rotation of the rotatable fluid passage body, the fluid passage opening is temporarily aligned with the first inlet port which allows fluid to enter the vortex chamber and create a clockwise vortex therein and increase the backpressure across the apparatus; and a second inlet port in fluid communication with the vortex chamber, the first inlet port positioned such that during rotation of the rotatable fluid passage body, the fluid passage opening is temporarily aligned with the second inlet port which allows fluid to enter the vortex chamber and create a counter-clockwise vortex therein and increase the backpressure across the apparatus.

5. The apparatus of claim 4 wherein the first inlet port and the second inlet port are positioned relative to the vortex chamber such that fluid is directed substantially tangentially into the vortex chamber.

6. The apparatus of claim 4 wherein the second inlet port is positioned relative to the vortex chamber such that fluid is directed towards a center portion of the vortex chamber.

7. The apparatus of claim 1 wherein the stator is constructed of elastomeric materials or substantially metallic materials.

8. The apparatus of claim 1 wherein the fluid flow restrictor is disposed within a lower thrust bearing that is disposed within the second end of the cylindrical hollow body and adjacent to the rotatable fluid passage body, the lower thrust bearing sustaining rotational and sliding contact with the rotatable fluid passage body when the rotatable fluid passage body rotates.

* * * * *